United States Patent [19]

Enderlin

[11] Patent Number: 4,949,558

[45] Date of Patent: Aug. 21, 1990

[54] SEALING HEADS FOR AN ENCLOSURE FOR CONTINUOUS STEAM TREATMENT OF TEXTILE YARNS

[75] Inventor: Robert Enderlin, Morschwiller-Le-Bas, France

[73] Assignee: Passap Knitting Machines, Inc., Salt Lake City, Utah

[21] Appl. No.: 328,612

[22] Filed: Mar. 27, 1989

[30] Foreign Application Priority Data

Mar. 25, 1988 [FR] France ..... 88 04147

[51] Int. Cl.[5] ..... D06B 23/18

[52] U.S. Cl. ..... 68/5 E; 34/242; 68/258; 100/170

[58] Field of Search ..... 68/5 E, 258, 260, 261; 34/242; 100/170

[56] References Cited

U.S. PATENT DOCUMENTS

| | | | |
|---|---|---|---|
| 2,027,283 | 1/1936 | McFadden | 68/258 X |
| 2,312,726 | 3/1943 | Munro | 100/170 X |
| 2,365,621 | 12/1944 | Bender | 68/258 X |
| 2,738,663 | 3/1956 | Moore | 68/258 |
| 2,851,869 | 9/1958 | Quoos et al. | |
| 2,900,951 | 8/1959 | Kabelitz | |
| 2,929,614 | 3/1960 | Young et al. | 34/242 X |
| 3,023,695 | 3/1962 | Kusters | 100/170 |
| 3,260,000 | 7/1966 | Schiffer | 34/242 |
| 3,299,676 | 1/1967 | Fujihashi | 68/5 E |
| 3,511,065 | 5/1970 | Peter | |
| 3,527,159 | 9/1970 | Edwards | 100/170 |
| 4,297,967 | 11/1981 | Osta | 100/170 X |
| 4,406,139 | 9/1983 | Schiffers | |

FOREIGN PATENT DOCUMENTS

| | | | |
|---|---|---|---|
| 1289922 | 2/1962 | France | |
| 1565215 | 4/1969 | France | |
| 2453927 | 11/1980 | France | |
| 2453928 | 11/1980 | France | |
| 2611755 | 9/1988 | France | |
| 822833 | 11/1959 | United Kingdom | |
| 1354250 | 5/1974 | United Kingdom | 68/5 E |
| 2022158 | 12/1979 | United Kingdom | |
| 2099868 | 12/1982 | United Kingdom | |

*Primary Examiner*—Philip R. Coe

*Attorney, Agent, or Firm*—Sandler, Greenblum & Bernstein

[57] ABSTRACT

Enclosure having a controlled atmosphere for the continuous treatment of textile yarns deposited on a continuous conveyor belt outside the enclosure and transported by the conveyor belt through the enclosure. The enclosure is at least partially sealed and includes an inlet and an outlet which are traversed by the conveyor belt, each having a sealing head with rollers, in which each sealing head includes at least one lower roller and an upper roller which are positioned transversely and across from one another below and above the conveyor belt, respectively. The sealing head is arranged to have a biasing force exerted by one of the rollers in the direction of the other in a manner so as to tighten the conveyor belt and yarns that it carries between them. The biasing arrangement includes at least one hydraulic jack connected to a hydraulic pressure source via a control and adjustment device.

16 Claims, 2 Drawing Sheets

SEALING HEADS FOR AN ENCLOSURE FOR CONTINUOUS STEAM TREATMENT OF TEXTILE YARNS

BACKGROUND OF THE INVENTION

1. Field of the Invention

The present invention relates, in general, to an enclosure having a controlled atmosphere for the continuous treatment of textile yarns deposited on a continuous conveyor belt outside of the enclosure and transported by the conveyor belt through the enclosure. The invention relates more particularly to a sealing head having rollers for the passage of the conveyor belt through the inlet and outlet of the enclosure.

2. Discussion of Background and Relevant Information

The yarns which travel continuously through such an enclosure, in particular through a steaming process enclosure under pressure, are generally deposited in the form of staggered spirals on one or more conveyor belts which circulate horizontally through the enclosure and traverse, at the inlet and at the outlet of the enclosure, sealing heads having rollers which enclose the belt and the yarns so as to prevent a substantial escape of steam.

To perform this function, a known sealing head, illustrated schematically in FIG. 1, includes a body affixed to a wall of the treatment enclosure and carries in a rotating manner a lower stationary roller 2, above which an upper roller 3 is movable in a substantially vertical direction. To this end, the roller 3 rotates on an axis of which each end is mounted in an oscillating bearing 4 at one end of a respective oscillating lever 5 whose other end is journalled at axis 6 on body 1. One or more springs 7 are biased against the lever 5 and are carried by adjustment rods 8 mounted on a frame 9 that can be locked on the body 1. The rods 8 are threaded to permit the adjustment of the compression of the springs 7. The two levers 5 are independently movable with respect to each other, such that the upper roller 3 can be inclined with respect to the roller 2 if the amount of yarn is thicker on one side of the conveyor than the other. The two arms oscillate together if the thickness of the yarn deposited on the conveyor varies, particularly as a function of the density of the deposit of yarn in spirals disposed on the conveyor.

A major disadvantage of this type of device is that the tightening force between the rollers 2 and 3, exerted by the springs, varies with the spacing between the rollers. On the one hand, the rods 8 must be adjusted in length to more or less compress the springs 7 when one wants to deposit yarns having a different density. This requires a manual operation and a careful adjustment in the tension of the springs. On the other hand, when the upper spring 3 must be inclined to allow an asymmetrical deposit to pass, the springs 7 which are more tightly compressed on the side which is raised tend to exert an excessive force which raises the other end of the roller, thus creating a loss of sealing of the enclosure.

Another disadvantage is that a momentary occurrence of an excessive tightening force can disturb the deposit of yarn. Finally, each time that one wishes to release the pressure of the springs to raise the upper roller, a manual operation is necessary to unlock and tilt the frame 9.

SUMMARY OF THE INVENTION

Accordingly, it is an object of the present invention to provide a sealing arrangement for an enclosure through which a conveyor travels for the treatment of material carried by the conveyor, the sealing arrangment including:

(a) at least one fixed roller which is adapted to be positioned along a first side of the conveyor for guiding the conveyor for movement relative thereto;

(b) a movable roller which is rotatable around an axis which extends transversely to the direction of movement of the conveyor and which is adapted to be positioned along a second side of the conveyor;

(c) means for biasing the movable roller toward the fixed roller or rollers, the biasing means including:

(i) a first fluid jack connected proximate to one end of the movable roller;

(ii) a second fluid jack connected proximate to an opposite end of the movable roller; and (iii) means for maintaining a substantially constant pressure in the first and second jacks.

Preferably, according to the present invention, the first and second jacks are hydraulic jacks.

According to one aspect of the invention, the means for maintaining a substantially constant pressure in the first and second jacks includes a fluid circuit by which the first and second jacks are connected in parallel. The fluid circuit at least includes a supply conduit extending between the firs jack and the second jack and a return conduit extending between the first jack and the second jack.

According to another aspect of the invention, the means for maintaining a substantially constant pressure in the first and second jacks includes a fluid pressure source, a fluid circuit including a supply conduit extending therefrom and connected to respective supply fittings of the first and second fluid jacks, means for sensing the fluid pressure in the supply conduit, and means for adjusting the pressure in the supply conduit to maintain the pressure to be below a predetermined threshold level.

Further according to the invention, the biasing means includes a central processing unit for remotely controlling the adjusting means to change a threshold fluid pressure to thereby change the force by which the movable roller is biased toward the fixed roller or rollers.

According to a further aspect of the invention, the movable roller includes a resilient covering, and the arrangement further includes means for limiting the magnitude of movement of the movable roller toward the fixed roller or rollers, including means for adjusting the magnitude of movement.

The present invention is further described to an enclosure having a controlled atmosphere for the continuous treatment of textile yarns deposited on a continuous conveyor belt outside the enclosure and transported by the conveyor belt through the enclosure, the enclosure being at least partially sealed and including an inlet and an outlet which are traversed by the conveyor belt, each having a sealing head with rollers. The invention is further directed to the sealing head. Each the sealing heads of the inlet and the outlet includes at least one lower roller and an upper roller which are positioned transversely and across from one another below and above the conveyor belt, respectively, and means for biasing at least one of the rollers in the direction of the other in a manner so as to tighten between them the conveyor belt and yarns that it carries, the biasing means including at least one hydraulic jack connected to a hydraulic pressure source by means of control and adjustment means.

It is a further object of the invention to provide an enclosure in which the at least one lower roller is stationary on a body and in which the upper roller is movable in a substantially vertical plane and is connected to the hydraulic jack.

It is a further object of the invention to provide an enclosure in which each of the upper and lower rollers have a peripheral mounting of compressible material, and in which at least one adjustable stop member is positioned between the biasing means and the body, to limit the movement of the upper roller in the direction of the other whatever the tightening force exerted by the biasing means.

It is a still further object of the invention to provide an enclosure including two separately movable support members, positioned near the respective ends of the upper roller, each carrying one end of an axis of the upper roller and each connected to a respective hydraulic jack, and in which the two jacks communicate hydraulically between them so as to apply the respective tightening forces which are always substantially equal to each end of the upper roller.

It is a still further object of the invention to provide an enclosure in which the sealing head of the inlet and the sealing head of the outlet have biasing means with hydraulic jacks, the enclosure being provided with a central hydraulic pressure unit which includes control means and a common pressure limitation valve.

Still further according to the invention, each hydraulic jack is double-acting and is connected to spacing control means of the rollers.

The control and adjustment means are effective for controlling and adjusting, respectively, the biasing force and the position of the movable roller.

BRIEF DESCRIPTION OF THE DRAWINGS

The present invention will be better understood with the help of the following description of a preferred embodiment, in reference to the annexed drawings, in which.

DETAILED DESCRIPTION OF PREFERRED EMBODIMENTS

Figure 1:
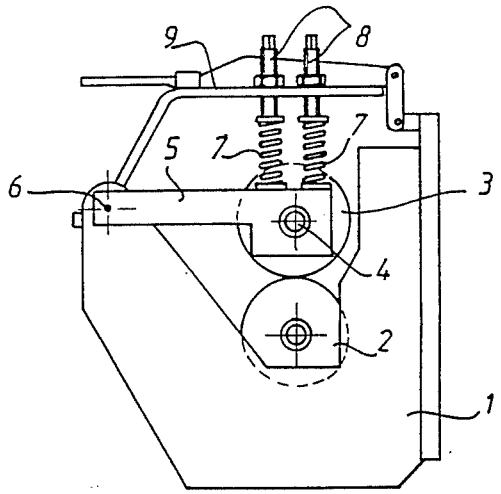
PRIOR ART FIG.1
FIG. 1 is an elevated lateral schematic view of a sealing head according to the prior art.

The present invention aims to avoid the disadvantages of the prior art as depicted in FIG. 1, by perfecting the sealing head in a manner such that the tightening means of the rollers ensures a tightening force which is substantially constant and that one can easily adjust, particularly by remote control.

According to a first aspect, the present invention relates to an enclosure having a controlled atmosphere for the continuous treatment of textile yarns deposited on a continuous conveyor belt outside the enclosure and transported by the conveyor belt through the enclosure. The enclosure is at least partially sealed and includes an inlet and an outlet which are traversed by the conveyor belt, each of which has a sealing head with rollers in which the sealing head of the inlet or the outlet includes at least one lower roller and an upper roller which are positioned transversely and across from one another below and above the conveyor belt, respectively.

The inlet and outlet further have tightening means arranged to bias at least one of the rollers in the direction of the other in a manner so as to tighten the conveyor belt and the yarns that it carries between them. The tightening means includes at least one fluid jack, preferably hydraulic, connected to a source of fluid pressure by means of control and adjustment means.

According to a second aspect, the present invention provides a sealing head for the inlet or the outlet of an enclosure for the treatment of textile yarns deposited on a conveyor belt traversing the sealing head, including at least one lower roller and an upper roller which are positioned transversely and across from one another, respectively, below and above the conveyor belt, and tightening means arranged to bias at least one of the rollers in the direction of the other in a manner so as to tighten between them the conveyor belt and yarns that it carries, in which the tightening means includes at least one hydraulic jack connected to a hydraulic pressure source by means of control and adjustment means.

Preferably, the lower roller is stationary on a body, whereas the upper roller is substantially movable in a substantially vertical plane and is connected to the hydraulic jack. In a preferred embodiment, the rollers have a peripheral fitting made of compressible material, and at least one adjustable stop member is positioned between the tightening means and the body to limit the movement of the upper roller in the direction of the other, whatever the tightening force exerted by the tightening means.

In a preferred embodiment, the sealing head includes two separately movable support members, positioned near the respective ends of the upper roller, each carrying one end of a roller axle and each connected to a respective hydraulic jack. The two jacks communicate hydraulically between them in a manner so as to apply respective tightening forces always substantially equal to each end of the roller. The two jacks can be connected to a common pressure limitation valve, connected to the preferred pressure source by means of a non-return valve, this valve being equipped withe a pressure adjustment member, which can be remotely controlled, if necessary.

In a particularly advantageous embodiment, the hydraulic jacks are double-acting and are connected to the spacing control means of the rollers, which makes it possible to press the rollers against one another and space them by means of the same jacks and a single hydroelectric power station.

Figure 2:
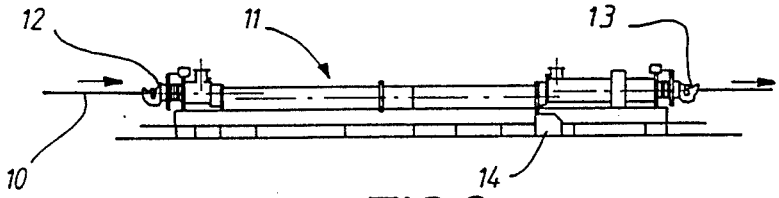
FIG. 2 is a lateral schematic view of an enclosure for a steaming enclosure under pressure, equipped with two sealing heads according to the invention.

With reference to FIG. 2, several juxtaposed and twisted textile yarns are deposited on a continuous conveyor belt 10 which is perforated and which conveys the yarns continuously through a complex treatment installation, such as a dyeing installation. This installation includes an enclosure 11 for a steaming process under pressure, in which the yarns are subjected to a thermal treatment serving, for example, to fix the dye in the yarns. The structure and the operation of such an enclosure are described in more detail in the published French Patent Application Nos. 2,453,927, 2,453,928 and 2,611,755. The blet 10 and the yarns that it carries enter the enclosure 11 by crossing a sealing head at the inlet 12 and leave it by crossing a sealing head at the outlet 13. The two heads according to the invention are constructed in a similar manner, so only one will be described in detail below. They are both activated and controlled from a common central processing unit 14 whose role will appear below and which includes a hydraulic pressure source.

Figure 5:
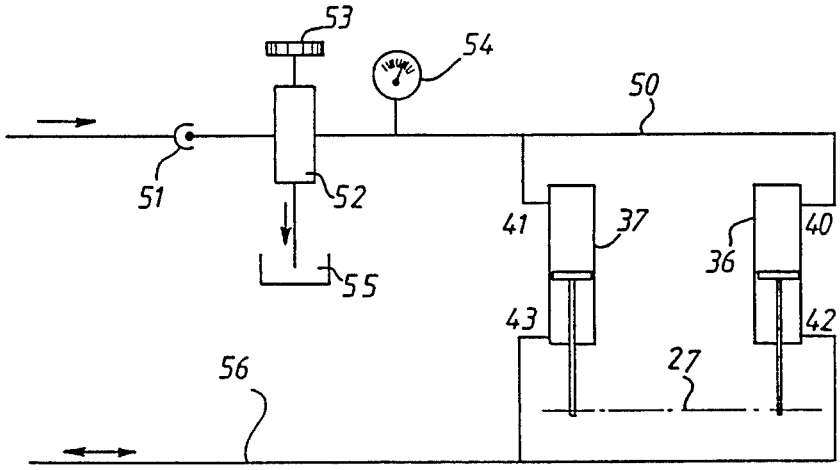
FIG. 5 is a simplified diagram of the hydraulic members of the head illustrated by FIGS. 3 and 4.
Figure 4:
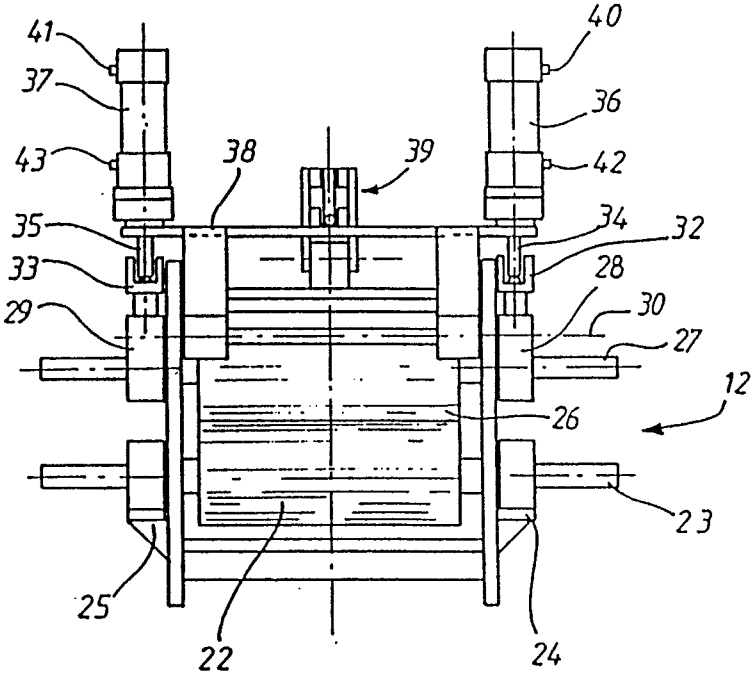
FIG. 4 is a front elevation view of a sealing head according to the invention.
Figure 3:
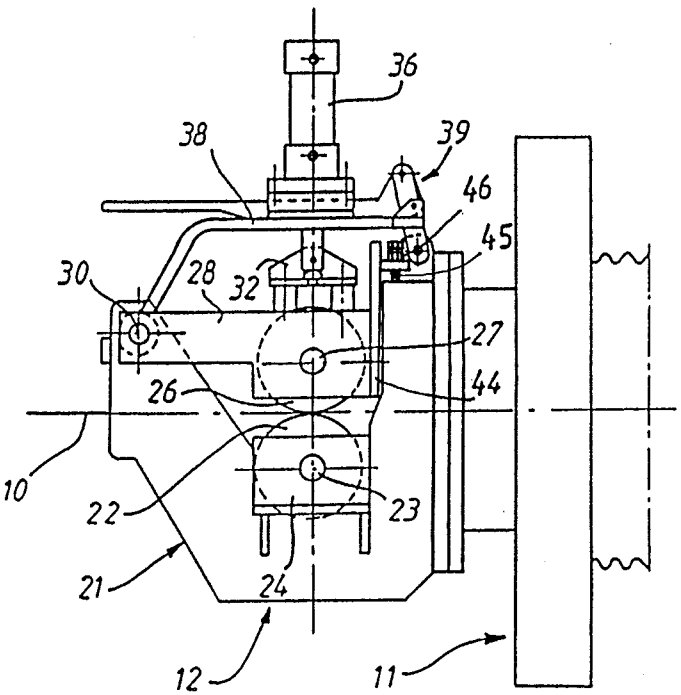
FIG. 3 is a lateral elevation view of a sealing head according to the invention.

With reference to FIGS. 3–5, the sealing head 12 comprises a body 21 carrying a stationary lower roller 22 over which the conveyor belt 10 passes, the roller 22 being mounted on an axis 23 rotated by a conventional chain and pinion systems (not shown) which are connected to a powered drive. The roller 22 turns in its bearings affixed to the body by the supports 24 and 25. As in the case of FIG. 1, there is provided above the belt 10 and the yarns that it carries, an upper roller 26 which is pressed against the yarns of the belt, and which is vertically movable, its axis 27 being carried by two independent lateral oscillating arms 28 and 29 having respective ends which are journalled on the body 21 with respect to an axis 30. Above axis 27 of the upper roller, each arm 28, 29 is provided with a brace 32, 33 connected to the piston rod 34, 35 of a respective double-acting hydraulic jack 36, 37 carried by a hinged frame 38. This frame is connected to the body 21 on the one hand by journalling around axis 30, to be able to be raised for maintenance, and on the other hand by a hand-controlled locking mechanism 39.

Each jack 36, 37 has an upper connection 40, 41 where the hydraulic fluid under pressure is introduced to push the respective lever 28, 29 downwardly, and a lower connection 42, 43 where the fluid is introduced to raise the respective arm, thus also the upper roller 26. It is to be noted that the amplitude of the vertical movements of the upper roller is relatively low, so that its axis 27, while pivoting around axis 30, remains approximately in a vertical plane passing through the axis 23 of the lower roller and the axes of the jacks 36 and 37. The brace 32, 33 can be affixed to the respective arm 28, 29 in a manner which absorbs the small horizontal displacements by means of resilient elements, made of rubber, for example. Furthermore, as in the case of FIG. 1, one of the arms 28 and 29 can be raised or lowered more than the other, the roller 26 then inclining transversely to be adapted to the shape of the deposit of yarns on the belt 10.

Preferably, rollers 22 and 26 have on their peripheries a rubber or otherwise elastomeric mounting which is slightly compressed by the tightening of the two rollers. To limit this compression and protect the rubber or elastomeric covering of the rollers, whatever the tightening force, each oscillating arm 28, 29 carries a support 44 having a threaded bolt 45 locked by a nut 46, so as to form an adjustable stop, resting against the body 21. Thus, one can limit the compression of the covering to a selected value, preferably between 0.5 and 2.0 mm.

As FIG. 5 shows, the connections 40 and 41 of the two jacks 36 and 37 are connected to a hydraulic conduit 50 which extends from the hydraulic pressure source of the central processing unit 14 by traversing a non-return valve 51 and a pressure limitation valve 52 equipped with an adjustment member 53. When the pressure in the connections 40 and 41 of the jacks, indicated by a pressure gauge 54, goes beyond a threshold determined by the member 53, the valve 52 is controlled to allow a small amount of fluid to escape to a reservoir 55 so as to maintain a substantially constant pressure in the jacks. Furthermore, the connections 42 and 43 of the two jacks are connected to the central processing unit 14 by a common conduit 56. Thus, the upper chambers of the two jacks are connected between them, as are the lower chambers, so that the piston of one of the jacks can be displaced in one direction, whereas the piston of the other jack is displaced as much in the opposite direction, without the pressures substantially varying in the jacks, thus without modification of the forces that the jacks exert on the axis 27 of the upper roller 26, whatever the position of the latter in height and in incline. If the spacing between the rollers 22 and 26 must increase to allow a particularly thick spiral of yarn to pass, the limitation valve 52 allows the prescribed quantity of fluid to escape and prevent the pressure from increasing substantially in the jacks.

The sealing head of the outlet 13 can be constructed like the inlet head 12, but symmetrically, and it operates in the same manner.

By virtue of the hydraulic control, the sealing heads 12 and 13 can be entirely activated and controlled remotely, for example, by means of a control block incorporated into the central processing unit 14, or in a control console of the installation unit. In particular, one can include the adjustable valve 52 in this control block (or even equip it with an electric remote control), which makes it possible to instantaneously adjust, to the extent desired the tightening force of the rollers in each of the sealing heads, for example to adapt them to another density of deposit of yarns, to another quality of the yarns, or to another velocity of the conveying belt.

Furthermore, it must be noted that the device controlled by a central processing unit, as shown by FIG. 2, can be installed easily in place of a conventional device, since one can install the central processing unit 14 while the installation operates with the old sealing heads. It suffices then to have a relatively brief interruption of the operation to change the two heads and to connect them to the hydraulic connections prepared in advance.

The present invention is not limited to the embodiments described above by way of example, but it extends to any modifications or alternative which would be apparent to one having ordinary skill in the art. In particular, the use of a sealing head of the type described extends to any enclosure for continuous treatment or textiles or other materials, including chemical treatments using humidity or gases.

I claim:

1. Enclosure having a controlled atmosphere under a predetermined pressure for the continuous treatment of textile yarns deposited on a continuous conveyor belt outside of said enclosure and transported by said conveyor belt through said enclosure, said enclosure being at least partially sealed and comprising an inlet and an outlet which are traversed by said conveyor belt, said inlet and outlet each having a sealing head with rollers, in which each of said sealing heads of said inlet and the outlet comprises at least one fixed roller and one movable roller, wherein at least one of said fixed and movable rollers has a peripheral mounting of compressible material, said fixed and movable rollers being positioned transversely and across from one another below and above said conveyor belt, respectively, each of said sealing heads further comprising a means for movably supporting a respective one of said movable rollers, each of said means for movably supporting including means for biasing a respective one of said movable rollers in the direction of a respective one of said fixed rollers so as to tighten between said respective fixed and movable rollers said conveyor belt and yarns that are carried, said means for movably supporting a respective one of said movable rollers comprising two separately movable support memebers, positioned near the respective ends of said movable roller, each support member carrying one end of an axis of said movable roller, wherein said biasing means comprising two hydraulic jacks connected to an axis of a respective movable roller, wherein said two hydraulic jacks are connected to a hydraulic pressure source by means of control and adjustments means, and wherein said two hydraulic jacks communicate hydraulically between them with a common pressure limiting valve so as to apply respective tightening forces which are always substantially equal at each end of said movable roller, and wherein at least one adjustable stop member is positioned in a manner so as to limit the biasing effect of said biasing means regardless of the biasing force.

2. Enclosure according to claim 1, in which said at least one fixed roller is stationary on a body and in which said movable roller is movable in a substantially vertical plane.

3. Enclosure according to claim 2, in which each of said rollers has a peripheral mounting of compressible material and in which said at least one adjustable stop member is positioned between said biasing means and said body, to limit the movement of said movable roller in the direction of said fixed roller whatever the tightening force exerted by said biasing means.

4. Enclosure according to claim 2, in which said enclosure being provided with a central hydraulic pressure unit which includes control means and said common pressure limiting valve.

5. Enclosure according to claim 1, in which each said hydraulic jack is double-acting and is connected to spacing control means of said rollers.

6. Enclosure according to claim 1, in which said control and adjustment means are effective for controlling and adjusting, respectively, the biasing force and the position of said movable roller.

7. Sealing head for the inlet or the outlet of a pressurized enclosure for treatment of textile yarns deposited on a conveyor belt traversing said sealing head comprising at least one fixed roller and at least one movable roller and means for mounting said movable roller for movement, at least one of said fixed and movable rollers having a peripheral mounting of compressible material, said rollers being positioned transversely and across from one another below and above said conveyor belt, respectively, means for biasing said movable roller in the direction of said fixed roller so as to tighten said conveyor belt and the yarns carried thereon between said rollers, wherein said biasing means comprises two hydraulic jacks connected to an axis of said movable roller, wherein said means for movably mounting said movable roller comprises two separately movable support members positioned near the respective ends of said movable roller, each carrying one end of an axis of said movable roller and each connected to a respective hydraulic jack, and in which said two jacks are connected to a hydraulic pressure source by means of control and adjustment means, wherein said two jacks communicate hydraulically between them so as to apply respective tightening forces which are always substantially equal to each of said movable roller, and an adjustable stop member positioned between said rollers in a manner so as to limit the biasing effect of said biasing means regardless of the biasing force exerted.

8. Sealing head according to claim 7 in which said fixed roller is stationary on a body and in which said movable roller is movable in a substantially vertical plane.

9. Sealing head according to claim 8, in which each of said rollers has a peripheral mounting of compressible material, and in which said adjustable stop member is positioned between said biasing means and said body to limit the movement of said movable roller in the direction of said fixed roller, whatever the tightening force exerted by said biasing means.

10. Sealing head according to claim 8, in which said two jacks are connected to a common pressure limiting valve.

11. Sealing head according to claim 10, in which said pressure limiting valve is connected to the pressure source by means of a non-return valve.

12. Sealing head according to claim 10, in which said pressure limiting valve is provided with a pressure adjustment member.

13. Sealing head according to claim 7, in which each said hydraulic jack is double-acting and is connected to said spacing control means of said rollers.

14. A sealing arrangement for a pressurized enclosure through which a conveyor travels for the treatment of material carried by said conveyor, said sealing arrangement comprising:

(a) at least one fixed roller which is adapted to be positioned along a first side of the conveyor for guiding the conveyor for movement relative thereto;

(b) a movable roller which is rotatable around an axis which extends transversely to the direction of movement of the conveyor and which is adopted to be positioned along a second side of the conveyor, wherein at least one of said fixed roller and said movable roller has a resilient covering;

(c) means for biasing said movable roller toward said at least one fixed roller, said biasing means comprising:

(i) a first hydraulic jack connected proximate to one end of said movable roller;

(ii) a second hydraulic jack connected proximate to an opposite end of said movable roller; and (iii) means for maintaining a substantially constant pressure in said first and second jacks, comprising a hydraulic pressure source, a fluid circuit including suppply conduit extending therefrom and connected to respective supply fittings of said first hydraulic jack and said second hydraulic jack, means for sensing the fluid pressure in said supply conduit, and means for adjusting the pressure in said supply conduit to maintain said pressure to be below a predetermined threshold pressure; and (d) an adjustable stop member for limiting the magnitude of movement of said movable roller toward said at least one fixed roller.

15. The sealing arrangement of claim 14 wherein said fluid circuit connects said first jack and said second jack in parallel and further includes a return conduit extending between said first jack and said second jack.

16. The sealing arrangement of claim 14 wherein said biasing means further comprises a central processing unit for remotely controlling said adjusting means to change a threshold fluid pressure to thereby change the force by which said movable roller is biased toward said at least one fixed roller.

* * * * *